US005676623A

United States Patent [19]

Yu

[11] Patent Number: 5,676,623

[45] Date of Patent: Oct. 14, 1997

[54] STEP EXERCISER

[76] Inventor: Hui-Nan Yu, P.O. Box 372, Hsin-Chu, Taiwan

[21] Appl. No.: 761,510

[22] Filed: Dec. 9, 1996

[51] Int. Cl.[6] ..... A63B 22/04

[52] U.S. Cl. ..... 482/53

[58] Field of Search ..... 482/51, 52, 53, 482/57, 148, 908, 111–113, 79, 80

[56] References Cited

U.S. PATENT DOCUMENTS

| | | | |
|---|---|---|---|
| 4,934,688 | 6/1990 | Lo | 482/53 |
| 4,934,690 | 6/1990 | Bull | 482/52 |
| 5,076,572 | 12/1991 | Wang | 482/53 |
| 5,232,421 | 8/1993 | Chen | 482/53 |
| 5,308,301 | 5/1994 | Chiarello | 482/53 |

*Primary Examiner*—Stephen R. Crow

[57] ABSTRACT

A step exerciser including a base frame having a support, an adjustable wheel holder mounted in the support and holding a pulley, two rockers pivoted to the support at two opposite sides, two pedals having a respective front end respectively pivoted to the rockers, two hydraulic cylinders bilaterally pivoted to the base frame at the rear side, two guide rods pivotably connected between the pedals and the piston rods of the cylindrical cylinders, two links pivotably connected between the piston rods of the hydraulic cylinders and the rockers, and two actuating rods respectively turned about the connections between the links and the piston rods of the hydraulic cylinders and pivotably connected between the opposite sides of the support and two opposite ends of a steel cable, which is mounted on the pulley.

1 Claim, 6 Drawing Sheets

STEP EXERCISER

BACKGROUND OF THE INVENTION

The present invention relates to step exercisers, and relates more particularly to such a step exerciser in which the elevations of the pedals are alternatively changed when they are pedaled.

Regular step exercisers are commonly comprised of two pedals bilaterally turned about a pivot and supported on a respective hydraulic cylinder. When the pedals are alternatively pedaled, the hydraulic cylinders impart a resisting force to the respective pedals. Because the pedals are simply turned about the pivot while pedaling, the elevation of the pedals does not change. Because the elevation of the pedals does not change, less exercising effect can be achieved.

SUMMARY OF THE INVENTION

The present invention has been accomplished under the circumstances in view. It is one object of the present invention to provide a step exerciser which automatically changes the elevation of the pedals when the pedals are pedaled. It is another object of the present invention to provide a step exerciser which causes the pedals to tilt outwards when the pedals are pedaled. According to the preferred embodiment of the present invention, the step exerciser comprises a base frame having a support, an adjustable wheel holder mounted in the support and holding a pulley, two rockers pivoted to the support at two opposite sides, two pedals having a respective front end respectively pivoted to the rockers, two hydraulic cylinders bilaterally pivoted to the base frame at the rear side, two guide rods pivotably connected between the pedals and the piston rods of the cylindrical cylinders, two links pivotably connected between the piston rods of the hydraulic cylinders and the rockers, a steel cable mounted on the pulley, and two actuating rods respectively turned about the connections between the links and the piston rods of the hydraulic cylinders and pivotably connected between the opposite sides of the support and the two opposite ends of the steel cable.

DETAILED DESCRIPTION OF THE PREFERRED EMBODIMENT

Figure 1:
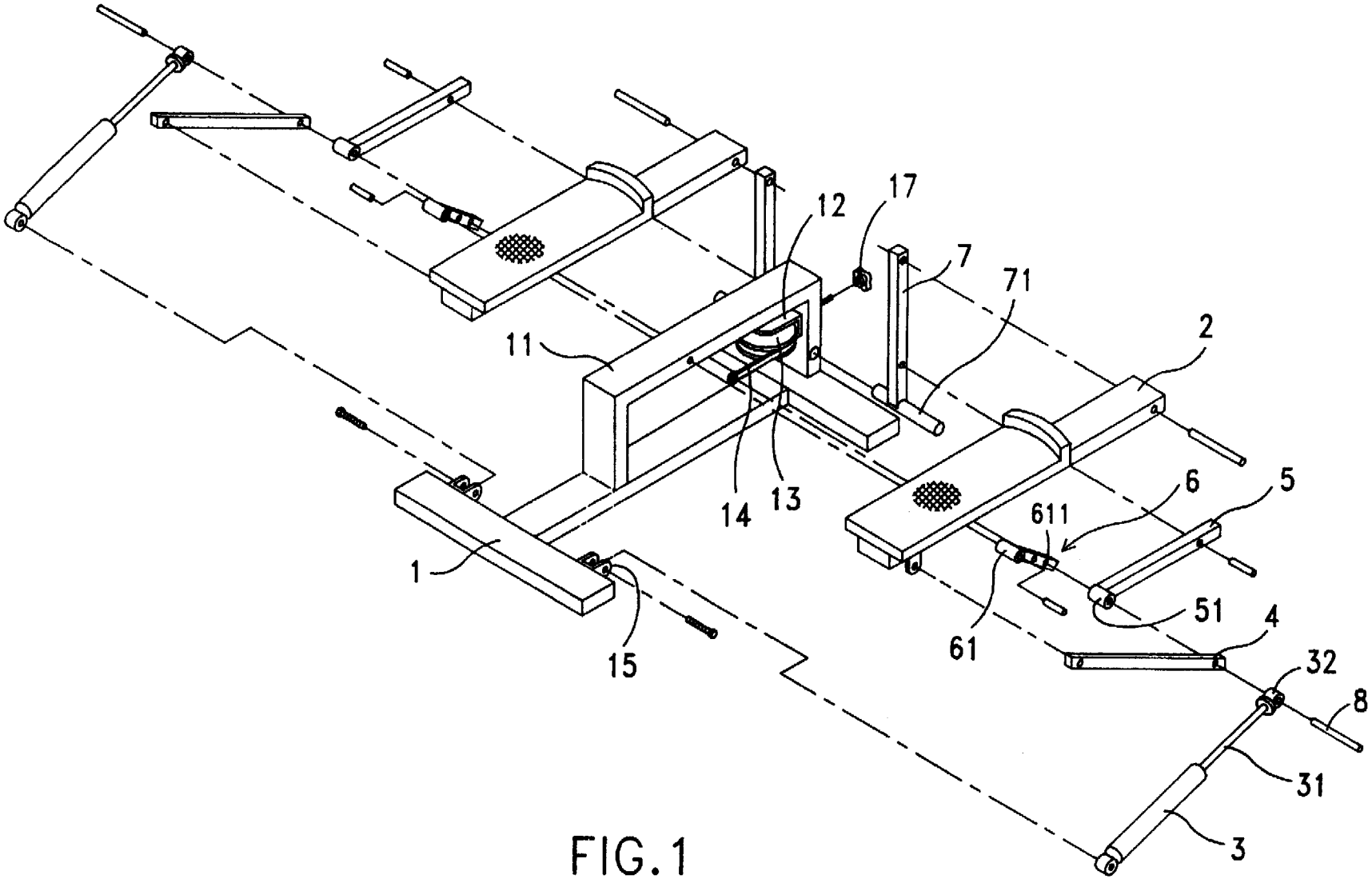
FIG. 1 is an exploded view of a step exerciser according to one embodiment of the present invention.
Figure 2:
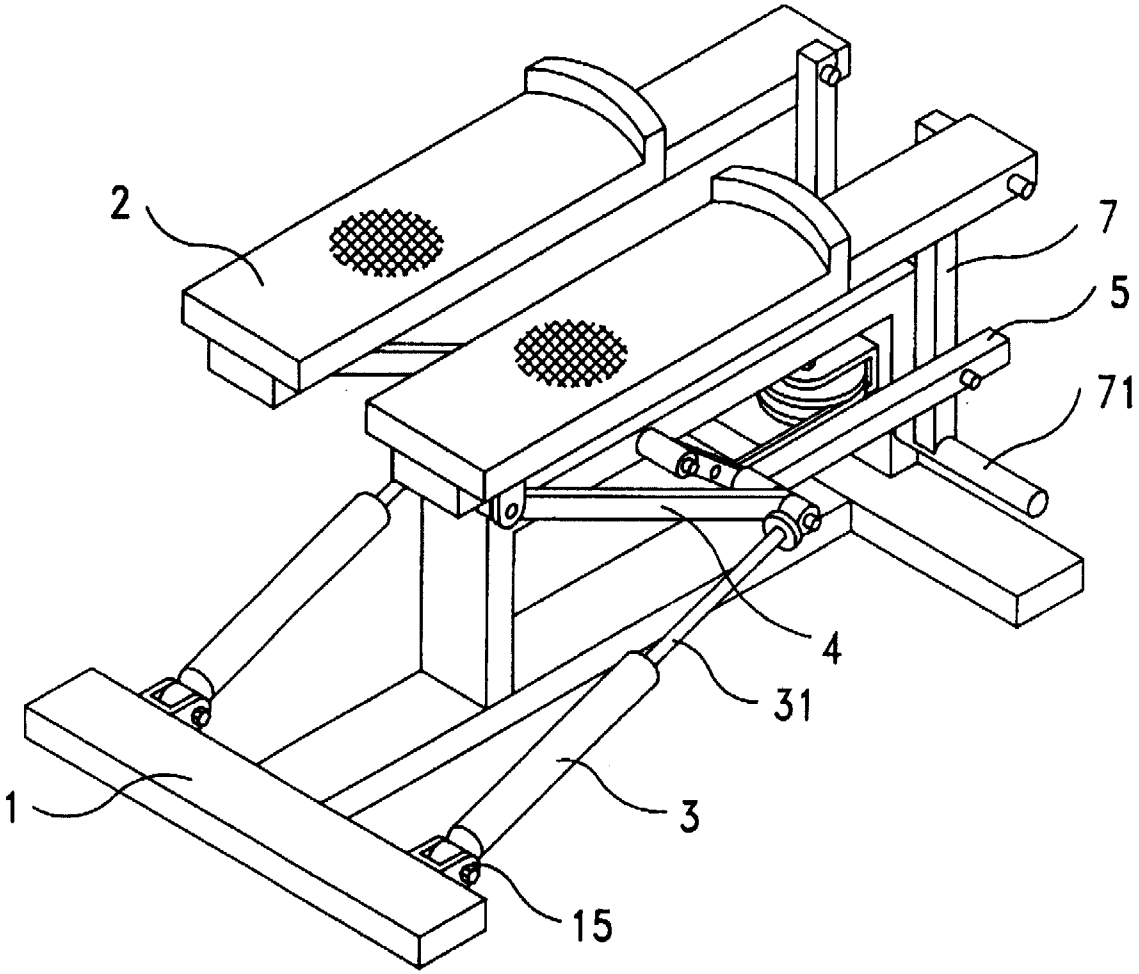
FIG. 2 is an elevational view of the step exerciser shown in FIG. 1.

Referring to FIGS. 1, 2, 3, 5 and 6A, a support 11 is raised from a substantially I-shaped base frame 1. A wheel holder 12 is mounted inside the support 11 near the front side of the base frame 1, having a screw rod 16 at one end inserted through a through hole (not shown) at the front side of the support 11. An adjustment nut 17 is threaded onto the screw rod 16 of the wheel holder 12, and disposed outside the support 11. A pulley 13 is mounted in the wheel holder 12. The I-shaped base frame 1 comprises two pairs of rear lugs 15 bilaterally disposed near the rear side. Two rockers 7 are bilaterally pivoted to the front side of the support 11. Each rocker 7 has a transverse bottom axle 71 turned in a respective axle hole (not shown) in the support 11. Two pedals 2 are respectively pivoted to the rockers 7 at the top. Two guide rods 4 are provided, having a respective rear end pivoted to the rear end of one pedal 2 and a respective front end pivoted to a respective link 5. The link 5 has a barrel 51 at the rear end coupled to one guide rod 4 by a pivot 8. The front end of the link 5 is pivoted to one rocker 7 near its transverse bottom axle 71. Two hydraulic cylinders 3 are respectively pivoted to the two pairs of lugs 15. The piston rods 31 of the hydraulic cylinders 3 have a respective outer end terminating in a respective eye head 32 respectively coupled to the pivots 8 at the barrels 51 of the links 5. Two actuating rods 6 are respectively turned about the pivots 8, each actuating rod 6 having a front end connected to one end of a steel rope 14, which is mounted on the pulley 13, a pivot hole 611 in the middle through which one pivot 8 passes, and a rear end 61 pivoted to the support 11 at one side in the middle.

Figure 3:
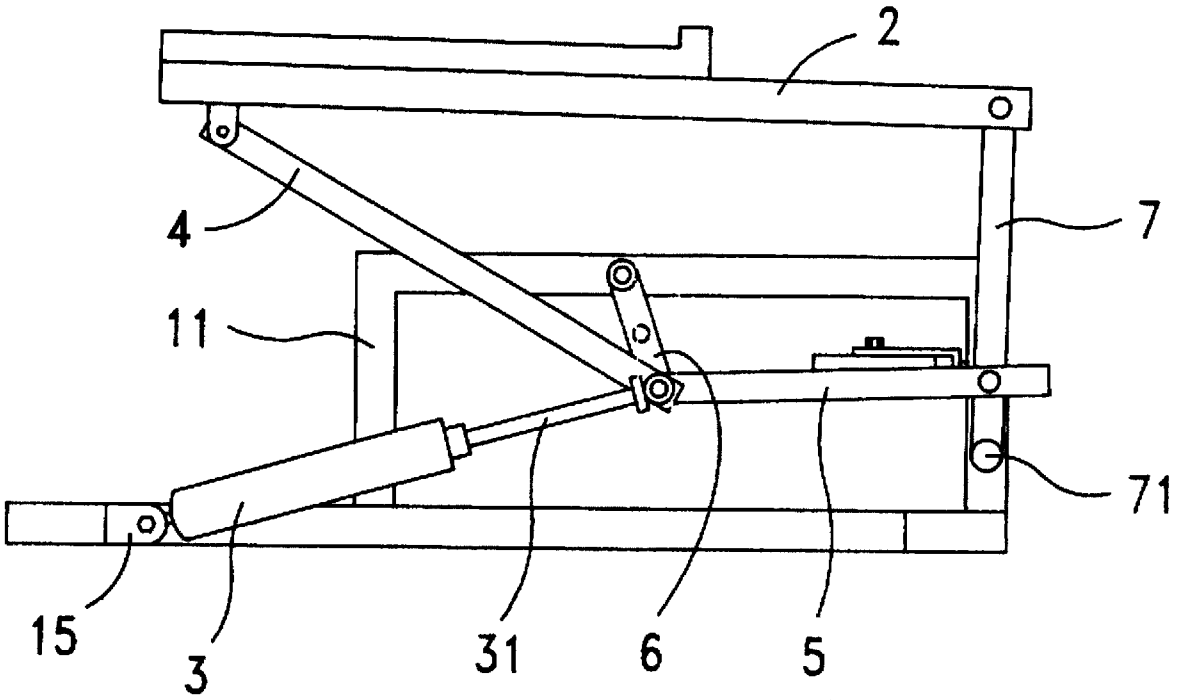
FIG. 3 is a side view of FIG. 2.
Figure 4:
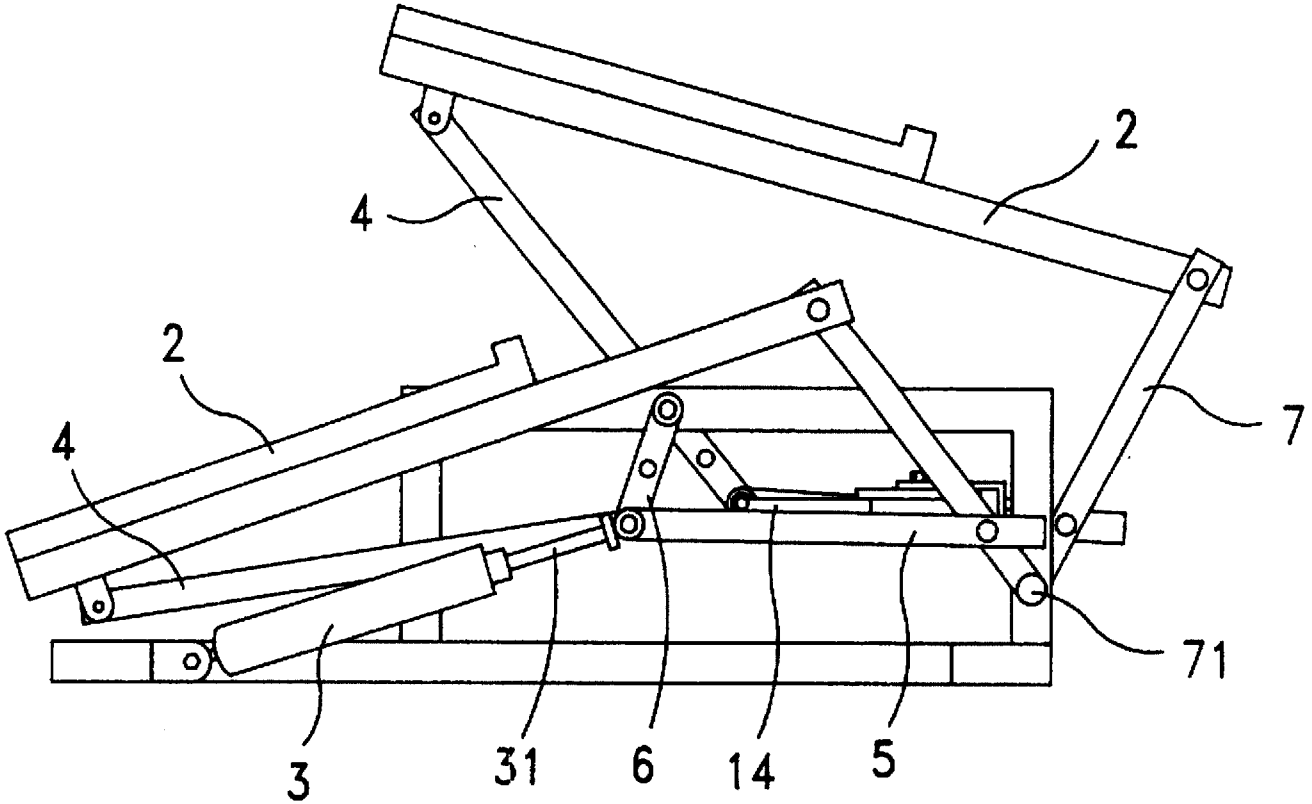
FIG. 4 is another side view of the present invention, showing the pedals moved relative to each other.
Figure 5:
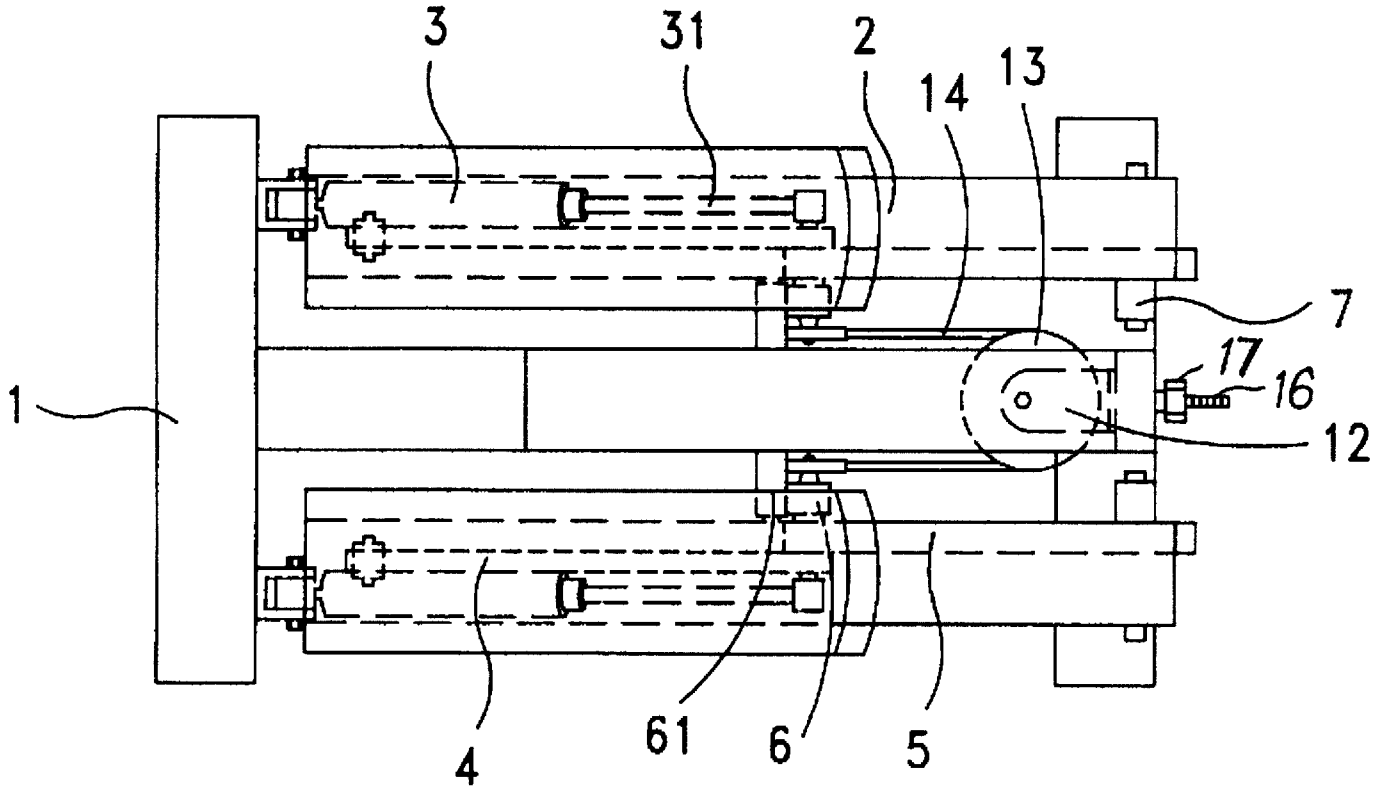
FIG. 5 is a top plain view of the present invention, showing the pedals pedaled.

Referring to FIGS. 3 and 4, when one pedal is pressed down, the corresponding rocker 7 is turned backwardly downwards, causing the corresponding guide rod 4 to be moved from a tilted position into a substantially horizontal position in longitudinal alignment with the corresponding link 5, and at the same time the corresponding actuating rod 6 is turned backwards to force the piston rod 31 back to the inside of the corresponding hydraulic cylinder 3. When one actuating rod 6 is turned backwards, the steel rope 14 is pulled, thereby causing the other actuating rod 6 to be turned forwards. Through the linking effect of the guide rods 4, the rockers 7 and the links 5, the pedals 2 are caused to tilt outwards alternatively when they are pedaled, and at the same time the elevations of the pedals 2 are alternatively changed.

Figure 6B:
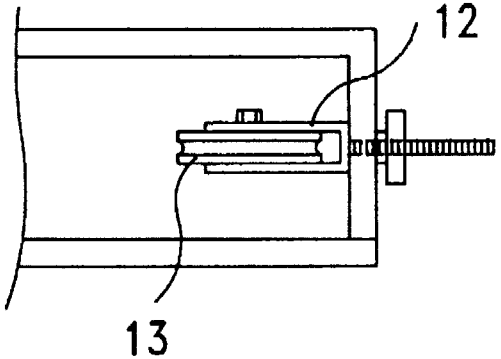
FIG. 6B is an assembly view of FIG. 6A.
Figure 6C:
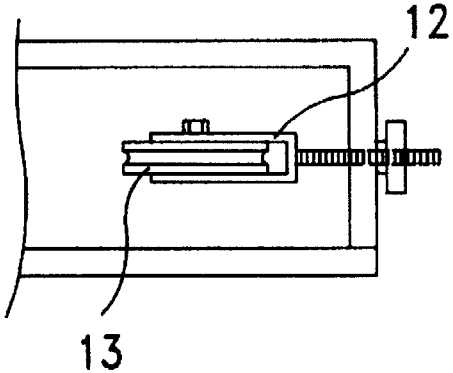
FIG. 6C is similar to FIG. 6B but showing the adjustment nut adjusted.
Figure 6A:
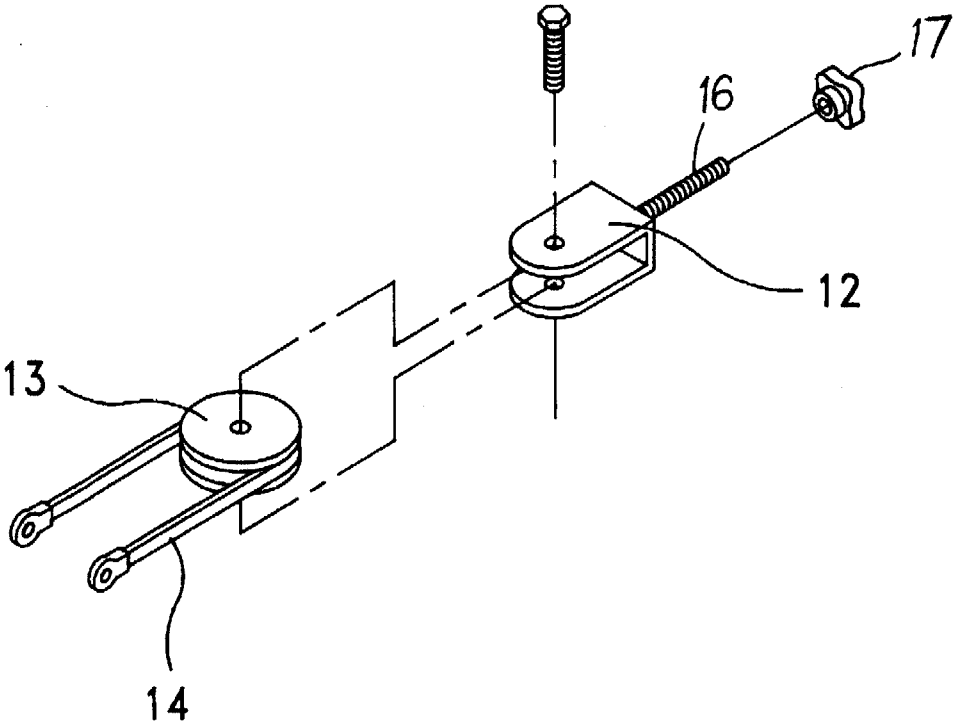
FIG. 6A is an exploded view of the wheel holder, the pulley, and the adjustment nut according to the present invention.

Referring to FIGS. 6A, 6B and 6C, the tension of the steel rope 14 can be adjusted by turning the adjustment nut 17. When the adjustment nut 17 is turned inwards, the wheel holder 12 is moved forwards, and the steel rope 14 is stretched. On the contrary, when the adjustment nut 17 is turned outwards, the steel rope 14 is released. When the steel rope 14 is released, the linking motion between the actuating rods 6 is eliminated.

While only one embodiment of the present invention has been shown and described, it will be understood that various modifications and changes could be made thereunto without departing from the spirit and scope of the invention disclosed.

What the invention claimed is:

1. A step exerciser comprising:

a base frame having a support raised from a top side, and two pairs of lugs bilaterally disposed at a rear side thereof;

a wheel holder holding a pulley and having a screw rod inserted through a through hole in said support;

an adjustment nut threaded onto said screw rod of said wheel holder to secure said wheel holder to said support;

two rockers respectively pivoted to said support at two opposite sides, each of said rockers having a bottom end pivoted to said support at one side, and a top end;

two pedals respectively pivoted to said rockers, each of said pedals having a front end pivoted to said top end of one rocker, and a rear end;

two guide rods, each of said guide rods having a rear end pivoted to said rear end of one pedal, and a front end;

two links, each of said links having a rear end pivoted to said front end of one guide rod by a pivot, and a front end pivoted to one rocker near the bottom end of said rocker;

two actuating rods respectively turned about the pivots between the rear ends of said links and the front ends of said guide rods, each of said actuating rods having a rear end pivoted to rear end of one pedal and a front end;

a steel cable mounted on said pulley, having two opposite ends respectively connected to the front ends of said actuating rods; and, two hydraulic cylinders respectively pivoted to the two pairs of lugs of said base frame, having a respective piston rod respectively pivoted to the pivots between the rear ends of said links and the front ends of said guide rods.

* * * * *